United States Patent [19]

Morton

[11] Patent Number: 4,894,967

[45] Date of Patent: Jan. 23, 1990

[54] FLUTED DECK DIAPHRAGM AND SHEAR RESISTING MEMBER THEREFOR

[75] Inventor: Virgil R. Morton, Benicia, Calif.

[73] Assignee: Verco Manufacturing Co., Phoenix, Ariz.

[21] Appl. No.: 264,070

[22] Filed: Oct. 28, 1988

[51] Int. Cl.[4] ..... E04B 1/24; E04B 5/17

[52] U.S. Cl. ..... 52/334; 52/630; 228/182; 29/155 R

[58] Field of Search ..... 228/165, 182; 52/630, 52/334–336, 578, 73, 326, 327; 105/422; 244/119 R; 29/155 R

[56] References Cited

U.S. PATENT DOCUMENTS

| | | | |
|---|---|---|---|
| 1,191,283 | 7/1916 | Conwell . | |
| 1,939,732 | 12/1933 | Stresau | 228/165 |
| 2,275,037 | 3/1942 | Watter | 105/422 |
| 2,694,475 | 11/1954 | Crafton | 52/578 |
| 2,992,711 | 7/1961 | Mitchell et al. | 189/36 |
| 3,108,662 | 10/1963 | Schick | 189/34 |
| 3,251,167 | 5/1966 | Curran | 52/336 |
| 3,392,499 | 7/1968 | McManus | 52/483 |
| 3,527,007 | 9/1970 | McManus | 52/327 |
| 3,533,204 | 10/1970 | Wallace et al. | 52/236 |
| 3,604,167 | 9/1971 | Hays | 52/336 |
| 3,624,980 | 12/1971 | McManus | 52/327 |
| 3,720,029 | 3/1973 | Curran | 52/334 |
| 3,759,006 | 9/1973 | Tambois | 52/406 |
| 3,820,295 | 6/1974 | Folley | 52/630 |
| 3,959,942 | 6/1976 | Merson | 52/630 |
| 4,186,535 | 2/1980 | Morton | 52/250 |
| 4,189,883 | 2/1980 | McManus | 52/250 |
| 4,285,173 | 8/1981 | Grearson et al. | 52/73 |
| 4,295,310 | 10/1981 | McManus | 52/334 |
| 4,333,280 | 6/1982 | Morton | 52/167 |
| 4,335,557 | 6/1982 | Morton | 52/741 |

OTHER PUBLICATIONS

Modern Welding Technology, Howard B. Cary, Prentice Hall, Englewood Cliffs, N.J., 1979.

H. H. Robertson Co., Nov. 1971, "Metal Decking" brochure regarding Robertson Long Span (LS) Deck.

Peterson Construction Products, "Deck, Floor & Siding Systems" brochure published by Elwin G. Smith Division of Cyclops Corp. of Los Angeles, Calif.

*Primary Examiner*—James L. Ridgill, Jr.

*Attorney, Agent, or Firm*—Cahill, Sutton & Thomas

[57] ABSTRACT

A diaphragm for use in a building structure includes a fluted deck supported by horizontal support beams and includes a contoured shear resisting member disposed internally from an end of the fluted deck for stiffening the fluted deck against horizontal shear loads imposed upon the diaphragm. The bottom flutes of the fluted deck overlie at least one horizontal support beam with which the shear resisting member is associated. Both the shear resisting member and the associated support beam extend perpendicular to the flutes within the fluted deck. The shear resisting member includes a substantially planar horizontal flange which spans a number of the top flutes of the fluted deck, and a first series of welds secures the upper flange of the shear resisting member to the underlying top flutes. A series of spaced tabs extend downwardly from a side edge of the upper flanged, each spaced tab lying within a trough of the fluted deck. Each of the spaced tabs terminates at its lowermost end in a horizontal pad having a weld hole formed therein and lying adjacent to a bottom flute. A second series of welds secure each of the pads to an underlying bottom flute and extend through the underlying bottom flute to the horizontal support beam below, thereby precluding relative movement of the top and bottom flutes of the fluted deck.

26 Claims, 4 Drawing Sheets

FIG. 3
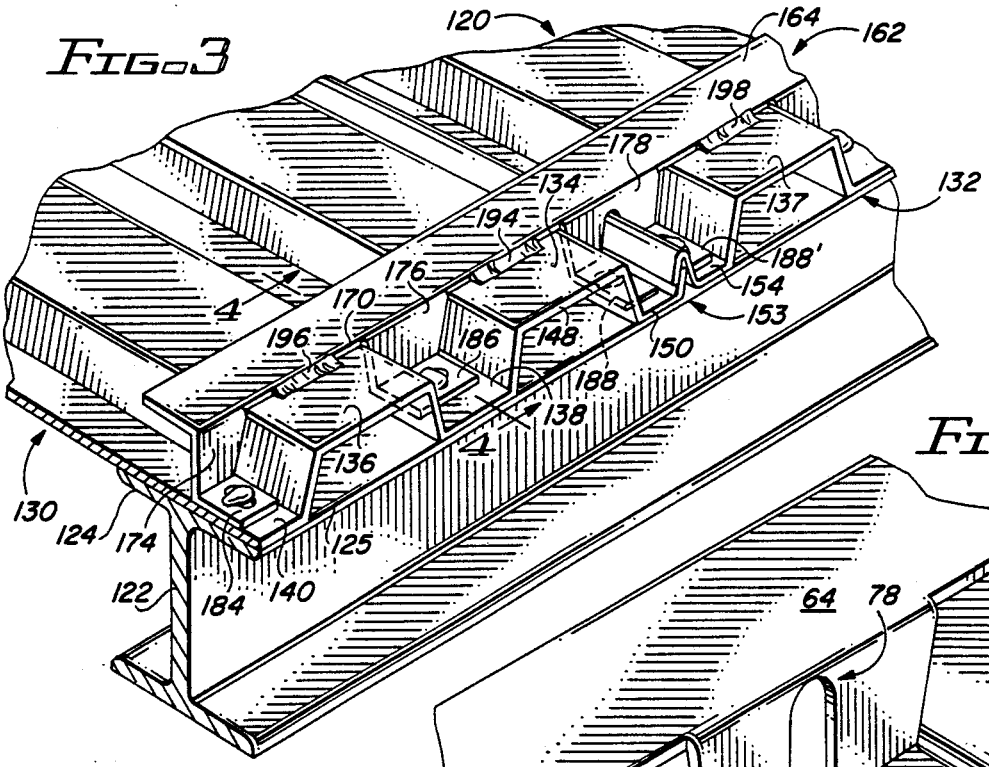
FIG. 5A
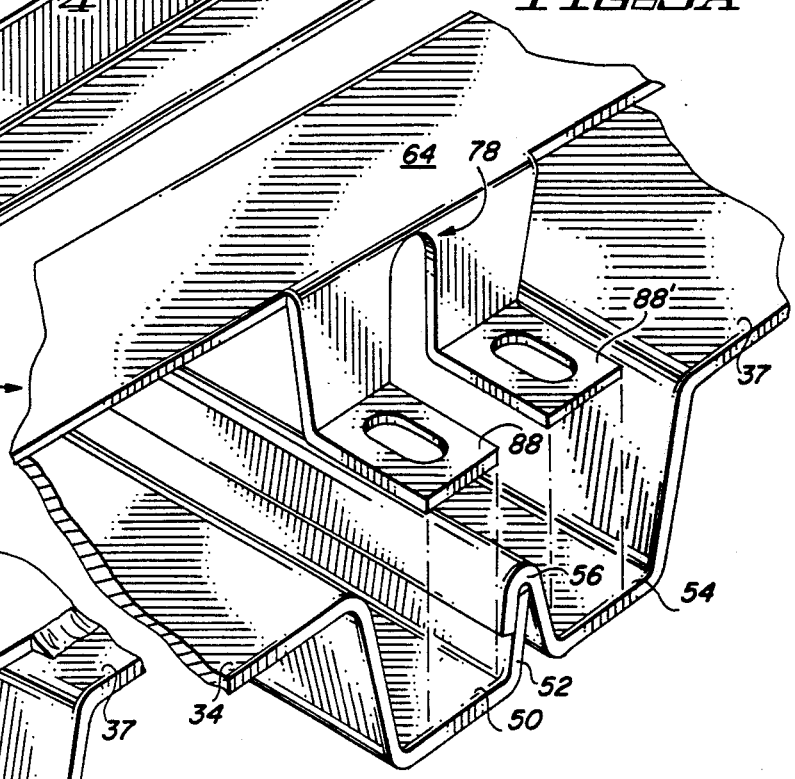
FIG. 5B
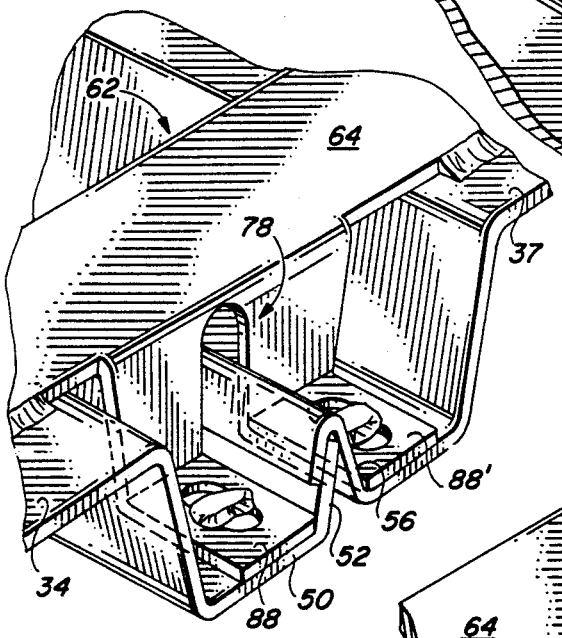
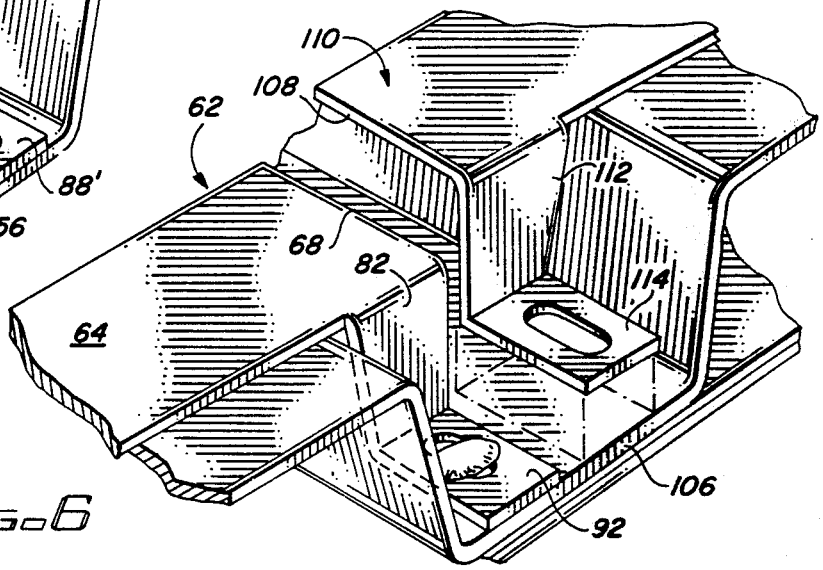
FIG. 6

FLUTED DECK DIAPHRAGM AND SHEAR RESISTING MEMBER THEREFOR

BACKGROUND OF THE INVENTION

1. Field of the Invention

The present invention relates generally to building structures and, more particularly, to diaphragms used within building structures to form roofs capable of resisting deformation due to the imposition of horizontal sheer loads.

2. Description of the Prior Art

In the field of building construction, diaphragms are horizontal elements disposed at the floor and roof levels which provide vertical support and resist horizontal shear loads. The types of horizontal shear loads of particular concern are shear loads caused by earthquakes and/or high winds. Typically, variously configured metal decks are used to form diaphragms at the floor and roof levels of large commercial buildings.

The shear resistance offered by a diaphragm is dependant on a number of variables, such as the thickness of the metal deck, the span of the deck, and the manner of connecting the diaphragm to the supporting frame. Another factor which influences the shear resistance of the diaphragm is the degree of stiffness of the diaphragm, since a stiff diaphragm will reduce or limit the deflection of the building walls. If the stiffness of the diaphragm is increased, then the size of the diaphragm may also be increased, as the ultimate size of the diaphragm is a function of the degree of diaphragm deflection.

A number of types of metal decking products are known and are commercially available for constructing floor and roof decking of buildings. One such metal decking product is often referred to as fluted deck because each deck panel is corrugated or fluted to resist vertical deflection when bearing a load. Fluted deck is characterized by a number of alternating top and bottom flutes extending parallel to the longitudinal axis of the fluted deck panel. The top flutes lie substantially in an upper plane, and the bottom flutes lie substantially in a lower plane spaced apart from the upper plane. The alternating top and bottom flutes are interconnected by a series of webs extending parallel to the longitudinal axis of the fluted deck. Fluted deck is commercially available from a number of manufacturers, including Verco Manufacturing Company of Phoenix, Arizona, the assignee of the present application. Fluted deck is available in a variety of gauges (i.e., metal thickness), heights (i.e., the distance between the upper and lower flutes), widths, and lengths. Such fluted deck panels typically span between underlying horizontal load bearing members, such as horizontal support beams and are typically welded at their ends to the upper flange of the underlying support beams. The horizontal support beams are, in turn, supported by vertical load bearing members, such as vertical support beams.

Horizontal shear force is a measure of the force exerted upon one end of a diaphragm which tends to twist or rotate the diaphragm in a horizontal plane relative to the opposing end of the diaphragm. When sufficiently strong horizontal shear loads are imposed upon a diaphragm constructed of fluted deck panels, a number of failures tend to arise, including breaking of welds which secure the lower flutes to the underlying horizontal support beam, breaking of attachment points securing adjacent side edges of adjoining fluted deck panels, and buckling of the upper and lower flutes and interconnecting webs within the fluted deck panels. Investigations have been conducted to determine the specific points of failure resulting from the imposition of horizontal shear loads upon fluted deck. By destructive testing, it has been learned that presently used fluted decks, or variations thereof, tend to buckle and deform with little translation of the shear load forces to the underlying horizontal support beams, or to the vertical load bearing members which support such horizontal support beams.

Various structures have been developed in an attempt to create diaphragms which can resist high shear loads and which are relatively stiff. A representative type of such structure is described and illustrated in U.S. Pat. No. 3,759,006 to Tamboise. This patent discloses an open bay network diaphragm constructed form a plurality of longitudinally oriented frame members, each having a closed trapezoidal cross section. Segmented transversely oriented trapezoidal members extend intermediate adjacent longitudinally oriented frame members. Terminal flanges are connected along the outer sides of the frame members to create a modular-like unit for attachment to a building framework. Each such diaphragm is relatively stiff and able to absorb shear loads; however, such diaphragms are not rigidly attached to the supporting framework, but instead rest upon insulating wedges. Accordingly, little if any of the shear loads imposed upon such diaphragm is transferred to the supporting building framework.

U.S. Pat. No. 3,820,295 to Foley discloses a building structure formed of corrugated steel decking within both the vertical walls and the flooring. The corrugated floor panels are secured to the corrugated vertical walls by reinforcing strips which nest with the vertical wall panels. However, the disclosed structure is incapable of transferring significant horizontal shear forces imposed upon the horizontal diaphragm through any horizontal load bearing members to any vertical load bearing members capable of resisting such horizontal shear forces.

U.S. Pat. No. 3,720,029 to Curran discloses a fluted deck structure wherein the ends of the deck are sealed off be elements extending transverse to the direction of the flutes. The ends of each such deck panel are welded to an underlying horizontal support beam. However, the deck structure shown in this patent is designed to receive a concrete fill, and transfer of horizontal shear forces between the diaphragm and the underlying horizontal support beam is accomplished by shear transfer studs extending from the horizontal support beam and embedded within the concrete fill.

Other U.S. patents disclosing structures usable as decks or diaphragms for building include U.S. Pat. Nos. 583,685; 2,194,113; 2,485,165; 2,804,953; 3,483,663; 3,656,270; 3,973,366; 3,724,078; 3,956,864; 3,995,403.

Long span metal deck structures formed of individual inverted L-shaped elements are also known. Each long span deck element includes an upper horizontal flange and a vertical flange extending downwardly from one edge of the horizontal flange, terminating in an inverted T-shaped leg which rests upon an underlying horizontal support beam. Such long span decks are formed by interlocking a number of aforementioned deck elements to provide a continuous, relatively flat deck. It is known to construct such long span metal deck structures in the form of cantilevered configurations. For example, the November 1971 Long Span Metal decking brochure published by H. H. Robertson Co. of Pittsburgh, Pennsylvania shows a form of long span, or "LS" metal decking which may be used to form cantilevered deck structures. Profile plates are installed within the deck structure above the external horizontal support beam to stiffen the deck structure. At interior butt joints, a continuous T-shaped shear plate is welded to the top of the metal deck and to the underlying horizontal support beam; a separate cover plate is then installed above the butt joint and is welded to the top of the deck on both sides of the butt joint.

In U.S. Pat. No. 4,186,535 issued to the present applicant and assigned to the present assignee, a shear load resistant structure is disclosed wherein a Z-shaped or C-shaped load translation member is secured along an open end of a fluted deck to the top flutes of the deck and to an underlying external horizontal support beam to increase the shear resistance of the fluted deck. The load translation member precludes relative movement of the top and bottom flutes and transfers horizontal shear loads imposed upon the diaphragm to the underlying horizontal support beam. The shear resistant diaphragm structure disclosed in the patent has been marketed commercially by the present assignee under the trademark "SHEARTRANZ"; significant cost savings have been achieved through the use of "SHEARTRANZ" fluted deck structures by permitting the use of lighter gauge fluted deck panels in combination with heavier gauge load translation members to stiffen the deck and obtain equal or greater shear resistance values as would be obtained through the use of heavier gauge fluted deck panels alone.

In U.S. Pat. Nos. 4,333,280 and 4,335,557, also issued to the present applicant, a further load translation member is disclosed in the form of a profile plate member having a plurality of profile plate bent upwardly at a 90° angle from a horizontal plate. The profile plates match the contour of the fluted deck and are welded to the webs and to the top flutes of the fluted deck along an open end thereof. The horizontal plate of the profile plate member is welded to the underlying horizontal support beam, as are the lower flutes of the fluted deck.

While the load translation members disclosed in the aforementioned U.S. Pat. Nos. 4,186,535; 4,333,280; and 4,335,557 all serve to increase the shear resistance of fluted deck diaphragms, the use of such load translation members imposes certain limitations upon the design of the diaphragms constructed therefrom. For example, each of the aforementioned Z-shaped, C-shaped and profile plate load translation members is adapted to be installed along an open end of the fluted deck, and is adapted to be welded to an underlying horizontal support beam. Thus, the use of such load translation members precludes the construction of cantilevered fluted deck structures wherein the open end of the fluted deck extends beyond and overhangs an external horizontal support beam.

Additionally, the Z-shaped and C-shaped load translation members shown in the aforementioned patents extend beyond the open end of the fluted deck and prevent the end of the fluted deck from fully extending to an adjacent vertical wall. While the profile plate member disclosed in U.S. Pat. Nos. 4,333,280 and 4,335,557 can be positioned to permit the end of the fluted deck to lie closely adjacent a vertical wall, the need to properly orient the profile plate member relative to the outer edge of the horizontal support beam, the need to properly orient the edge of the fluted deck relative to the profile plates, and the need to weld the profile plates to the ends of the webs and upper flutes, poses significant additional labor requirements for installation.

In large building structures, fluted deck panels are often placed end-to-end at internal horizontal support beams to form a continuous span; the end of one fluted deck panel is butted against the adjacent end of the next fluted deck panel, providing a so-called interior butt condition. As mentioned above, the Z-shaped and C-shaped load translation members disclosed in the aforementioned patent are designed to be installed along an open end of the fluted deck. Accordingly, such load translation members may not be installed along interior butt joints of a fluted deck diaphragm. While the profile plate members disclosed in the aforementioned U.S. Pat. Nos. 4,333,280 and 4,335,557 can be installed along interior butt joints, such profile plate members do not serve to join together the abutting ends of the respective fluted deck panels. Thus, while such a profile plate member may serve to stiffen one of the fluted deck panels, the abutting fluted deck panel is not simultaneously stiffened thereby. While a cover plate may be used to overlie the interior butt joint and join the upper flutes of the abutting fluted deck panels, the installation of such a cover plate requires additional welding steps, and increases the cost of construction.

Accordingly, it is an object of the present invention to provide a fluted deck diaphragm for use in a building structure and having a relatively high resistance to horizontal shear loads while using a less expensive, lighter gauge fluted deck panels.

It is another object of the present invention to provide such a fluted deck diaphragm wherein horizontal shear forces imposed upon the diaphragm are readily transferred to underlying horizontal load bearing members supported by vertical shear resisting load bearing members.

It is still another object of the present invention to provide such a fluted deck diaphragm having a cantilevered configuration.

It is yet another object of the present invention to provide such a fluted deck diaphragm including a shear resisting member interconnecting with the fluted deck and with the underlying horizontal support beam at a point spaced apart from the open end of the deck.

It is a further object of the present invention to provide such a fluted deck diaphragm wherein the open ends of the fluted deck lie directly adjacent a vertical exterior wall and incorporating a shear resistance member spaced apart from such vertical exterior wall.

It is a still further object of the present invention to provide such a fluted deck diaphragm incorporating a shear resisting member which may be easily installed at interior butt joints of the fluted deck for locking together the upper flutes of abutting fluted deck panels and transferring horizontal shear forces to the underlying horizontal support beam below the interior butt joint.

These and other objects of the present invention will become apparent to those skilled in the art as the description thereof proceeds.

SUMMARY OF THE INVENTION

Briefly described, and in accordance with one embodiment thereof, the present invention relates to a diaphragm for use in a building structure including a series of horizontal load bearing members for supporting the diaphragm and a series of vertical load resisting members for supporting the horizontal load bearing members; the diaphragm includes a fluted deck having a longitudinal axis and including alternating top and bottom flutes extending parallel to the longitudinal axis and a series of longitudinal axis and extending webs interconnecting alternating top and bottom flutes. At least one of the horizontal load bearing members extends perpendicular to the longitudinal axis of the fluted deck, and the lower surfaces of the bottom flutes overlie such horizontal load bearing member. The diaphragm includes a shear resisting member having an elongated section which extends perpendicular to the longitudinal axis of the fluted deck and extends over a number of top flutes of the fluted deck generally above and parallel to the underlying horizontal load bearing member. Extending downwardly from the elongated section of the shear resisting member are a number of spaced tabs, each of which extends within a trough formed by one of the bottom flutes and the webs interconnected therewith. Each of the spaced tabs extends toward the upper surface of one of the bottom flutes and has a lowermost portion disposed adjacent to the upper surface of such bottom flute.

A series of first welds rigidly secure the elongated section of the shear resisting member to the underlying top flutes, and a second series of welds rigidly secure the lowermost portion of each of the spaced tabs to the upper surface of a bottom flute adjacent thereto. The second series of welds preferably extend through the lower flutes for securing both the spaced tabs and the bottom flutes to the underlying horizontal load bearing member.

The elongated section of the shear resisting member is preferably planar for extending parallel with and closely adjacent to the upper flutes of the fluted deck lying therebelow. Each of the spaced tabs preferably includes a welding pad extending generally perpendicular to each spaced tab and parallel to and adjacent to the upper surface of an associated bottom flute. A hole is preferably formed in each welding pad to facilitate the formation of an arc spot weld securing the welding pad and bottom flute to each other and to the underlying horizontal load bearing member.

Fluted deck panels are interconnected along their side edges by sidelap seams which extend above the plane containing the lower flutes of the fluted deck. Accordingly, the shear resisting member preferably includes a spaced tab having an intermediate slot formed therein for permitting such slotted tab to extend around the raised sidelap interconnection formed between adjoining fluted deck panels. Preferably, the lowermost ends of each side of the slotted tab are provided with apertured welding pads lying adjacent the lower flute portions of the fluted deck panels lying on either side of the sidelap interconnection.

To facilitate the installation of such shear resisting members continually along a fluted deck diaphragm, the spaced tabs provided at the opposing ends of each shear resisting member preferably have a width substantially equal to one-half the width of each trough formed in the fluted deck panel, while the width of the spaced tabs intermediate the opposing ends of the shear resisting member have a width substantially equal to the width of each such trough. In this manner, two such shear resisting members may be placed in abutting end-to-end relationship wherein the respective end tabs of two adjoining shear resisting members are both contained within a common trough.

The planar elongated section, or upper horizontal flange, of the shear resisting member is preferably secured to the top flutes of the fluted deck by fillet welds, while the welding pads provided at the lowermost portions of the spaced tabs are preferably secured to the underlying lower flutes and horizontal support beams by arc spot welds.

One aspect of the present invention relates to a cantilevered fluted deck diaphragm incorporating the aforementioned shear resisting member. In this regard, the fluted deck extends along it longitudinal axis between first and second ends, the first end of the fluted deck being closer to a peripheral horizontal load bearing member than the opposite end of the fluted deck. The first end of the fluted deck nonetheless extends substantially beyond the peripheral horizontal load bearing member to provide a cantilevered deck structure, while the shear resisting member is installed generally above and welded to the peripheral horizontal load bearing member.

Another aspect of the present invention relates to a fluted deck diaphragm wherein the open ends of the fluted deck fully extend to an outer vertical wall constructed adjacent to the outer edge of an upper flange of a horizontal support beam. In this regard, the open end of the fluted deck panel extends fully to the external edge of the upper flange of the horizontal support beam to abut the interior surface of the external vertical wall. The aforementioned shear resisting member is installed to position the lowermost portions of the spaced tabs generally above the underlying horizontal support beam, while the elongated upper flange of the shear resisting member is spaced apart from the open end of the fluted deck.

The fluted deck diaphragm of the present invention may include interior butt joints formed between abutting ends of adjacent fluted deck panels. The shear resisting member is installed directly along the interior butt joint, with the planar elongated section of the shear resisting member simultaneously overlying a first set of top flutes of one fluted deck panel and overlying a second series of top flutes of the abutting fluted deck panel. The lowermost portions of the spaced tabs of the shear resisting member overlie the lower flutes of either one of the two abutting fluted deck panels generally above an underlying interior horizontal support beam. A first set of welds secure the planar elongated section along one edge thereof to the top flutes of one of the fluted deck panels and along the opposing side edge of the elongated section to the top flutes of the abutting fluted deck panel. A second series of welds secures the lowermost portions of the spaced tabs to the associated lower flutes and to the underlying horizontal support beam.

BRIEF DESCRIPTION OF THE DRAWINGS

FIG. 3 is a perspective view of a fluted deck diaphragm wherein the open end of the fluted deck is coextensive with the outer edge of the upper flange of an underlying horizontal support beam for permitting the fluted deck to abut the interior surface of an external vertical wall (not shown).

FIG. 5A is a detailed perspective view of a sidelap interconnection between adjoining fluted deck panels arranged in side-to-side relationship and illustrating the manner in which a slotted tab portion of the shear resisting member is positioned with respect to the sidelap interconnection.

FIG. 5B is a detailed perspective view of the components shown in FIG. 5A following welding operations.

FIG. 6 is a detailed perspective view of a trough of a fluted deck panel in which the abutting ends of two shear resisting members are positioned to form a substantially continuous, multiple segment shear resisting member.

DETAILED DESCRIPTION OF THE PREFERRED EMBODIMENTS

Figure 2B:
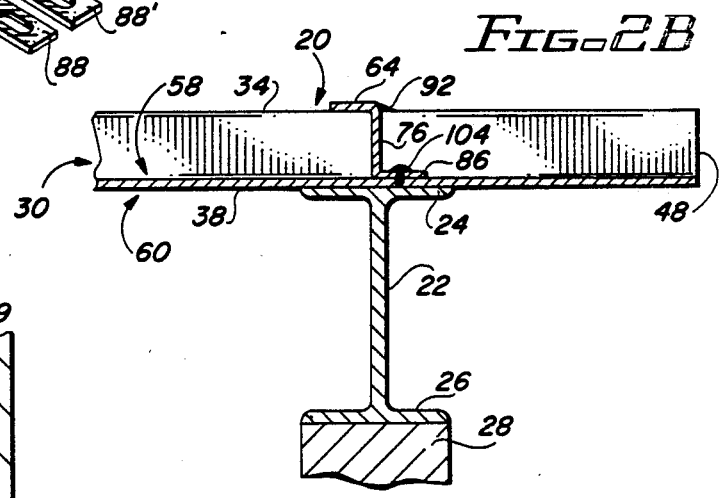
FIG. 2B is a sectional view of the fluted deck diaphragm shown in FIG. 2A taken through the plane designated by line 2B—2B shown in FIG. 2A.
Figure 2A:
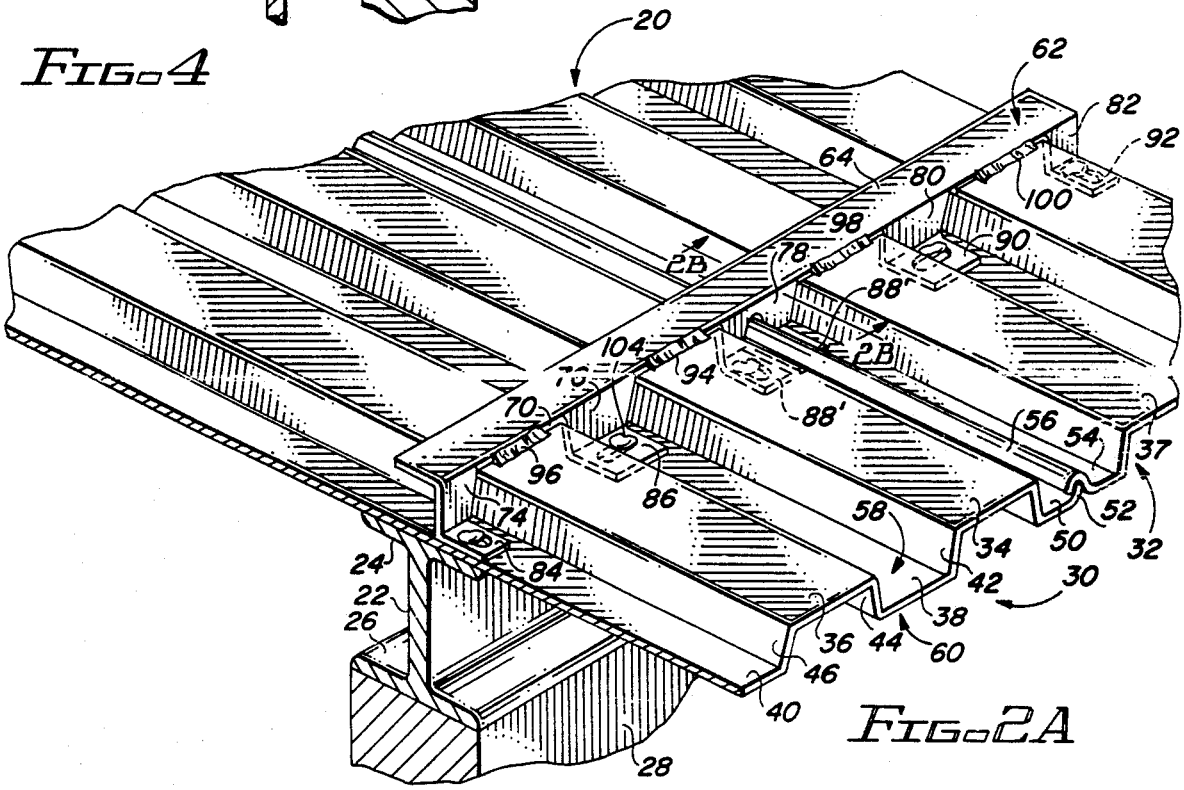
FIG. 2A is a perspective view of a portion of a cantilevered fluted deck diaphragm supported by a horizontal support beam and incorporating a shear resisting member like that shown in FIG. 1.

In FIGS. 2A and 2B, a fluted deck diaphragm is shown constructed according to the teachings of the present invention and designated generally to reference numeral 20. Fluted deck diaphragm 20 is supported by at least one horizontal load bearing member shown as horizontal support beam 22 made of steel. Horizontal support beam 22 includes an upper support flange 24 and a lower support flange 26. The building within which diaphragm 20 is incorporated further includes a series of vertical load bearing members for supporting the various horizontal support beams and for resisting any horizontal shear forces transferred thereto by horizontal support beam 22. As shown in FIGS. 2A and 2B, one of such vertical load bearing members is shown as a concrete pillar or concrete wall 28 upon which lower flange 26 is supported.

As shown in FIG. 2A, fluted deck diaphragm 20 is formed from two or more fluted deck panels, such as those designated by reference numerals 30 and 32. Fluted deck panel 30 includes two or more top flutes, such as 34 and 36, and two or more bottom flutes, such as those designated 38 and 40. As shown in FIG. 2A, fluted deck panel 30 extends along a longitudinal axis, and top flutes 34 and 36 and bottom flutes 38 and 40 extend parallel to such longitudinal axis. Top flutes 34 and 36 lie substantially in a first horizontal plane, while bottom flutes 38 and 40 lie substantially in a second horizontal plane spaced apart from and parallel to the first plane. Top flutes 34 and 36 are alternately interconnected to lower flutes 38 and 40 by webs 42, 44, and 46, each of which extends parallel to the longitudinal axis of fluted deck panel 30. For example, webs 42 and 44 interconnect bottom flute 38 to top flutes 34 and 36, respectively. Fluted deck panel 30 extend along its longitudinal axis from a first open end, shown in the lower right portion of FIG. 2A, and designated by reference numeral 48 in FIG. 2B, toward an opposing end (not shown). The aforementioned opposing end of fluted deck panel 30 is supported by a further horizontal load bearing member (not shown).

Fluted deck panels of the type shown as 30 and 32 in FIG. 2A are commercially available from a number of manufacturers, including Verco Manufacturing Co. of Phoenix, Arizona. Such fluted deck panels are available in varying widths and heights and metal gauge thickness. One such type of fluted deck panel is known in the trade as B-deck and is formed of 36 inch wide fluted panels including six top flutes spaces on six inch centers and seven bottom flutes, including two partial bottom flutes along the opposing side edges of each such deck panel. Another form of fluted deck panel that is commercially available is so-called "N-deck" available in 24 inch wide panels having a height of approximately 3 inches, each panel including three top flutes spaced on eight inch centers and four bottom flutes, including two partial bottom flutes along the opposing side edges of each such deck panel.

Referring again to FIG. 2A, fluted deck panel 30 includes a partial lower flute 50 which terminates in an upturned half-web 52. Fluted deck panel 32 includes an adjoining partial bottom flute 54 which terminates in an inverted hook-shaped channel which overlaps half-web 50 of deck panel 30 to form a sidelap interconnection between the adjoining panels. The sidelap interconnection between adjacent panels may be secured by welding or by the use of a button punching technique.

As shown in FIGS. 2A and 2B, the bottom flutes of fluted deck panel 30 and 32 each include an upper and lower surface. For example, bottom flute 38 includes an upper surface 58 and a lower surface 60. Lower surface 60 of bottom flute 38 rests upon upper flange 24 of horizontal support beam 22 and is supported thereby against vertical loads imposed upon fluted deck panel 30. Similarly, the lower surfaces of the other bottom flutes of deck panels 30 and 32 rest upon and are supported by upper flange 24 of support beam 22. As further illustrated in FIGS. 2A and 2B, horizontal support beam 22 extends perpendicular to the longitudinal axis of fluted deck diaphragm 20.

Those skilled in the art will appreciate that the fluted deck diaphragm configuration shown in FIGS. 2A and 2B is a cantilevered configuration wherein the open end 48 of fluted deck diaphragm 20 extends beyond and overhangs horizontal support beam 22. As explained above, none of the shear transfer members disclosed in U.S. Pat. Nos. 4,186,535, 4,333,280 or 4,335,557 may be used to transfer horizontal shear forces imposed upon fluted deck diaphragm 20 to underlying horizontal support beam 22 because the open end 48 of the deck extends well beyond upper flange 24 of horizontal support beam 22. However, the shear resisting member shown in FIG. 1 may advantageously be incorporated within fluted deck diaphragm 20, as shown in FIGS. 2A and 2B, to stiffen the fluted deck and to transfer horizontal shear forces from diaphragm 20 to horizontal support beam 22.

Figure 1:
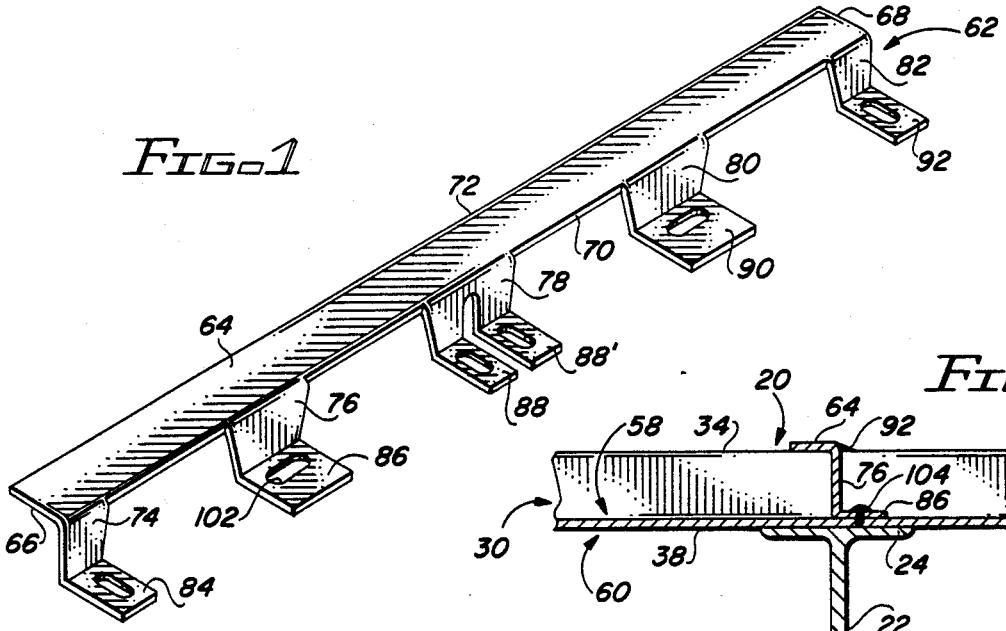
FIG. 1 is a perspective view of a shear resisting member for use in constructing a fluted deck diaphragm according to the teachings of the present invention.

As shown in FIG. 1, shear resisting member 62 includes an elongated planar section or upper horizontal flange 64 which extends between a first end 66 and an opposing second end 68. Shear resisting member 62 is preferably formed of 16 gauge steel. In the preferred embodiment, elongated flange 64 is approximately 1½inches wide and 24 inches in length. Elongated flange 64 includes a first side portion 70 and an opposing second side portion 72. Extending vertically downward from side portion 70 or horizontal flange 64 are a series of spaced tabs 74, 76, 78, 80 and 82. The aforementioned spaced tabs are spaced apart from one another by the same distance separating the centers of the bottom flutes of the fluted deck. Moreover, tabs 76, 78, and 80 have the form of inverted trapezoids inclining downwardly and inwardly to match the contour of the troughs formed within the fluted deck panels by each bottom flute and the webs alternately interconnected to the opposing side of each such bottom flute. Accordingly, when shear resisting member 62 is positioned above fluted deck diaphragm 20 perpendicular to the longitudinal axis thereof, elongated flange 64 extends over a number of top flutes, including 34 and 36, and each of the spaced tabs 74–82 extends within one of the troughs of fluted deck diaphragm 20. Each of the spaced tabs 74—82 terminates at its lowermost portion in a welding pad, such as those designated by reference numerals 84, 86, 88, 90 and 92, respectively, extending generally horizontal and parallel to horizontal flange 64. Welding pads 84—92 are spaced below elongated flange 64 by a distance corresponding to the depth of the troughs formed by fluted deck panels 30 and 32.

As mentioned above, each of the welding pads 84—92 is disposed adjacent and rest upon the upper surface of an associated bottom flute. For example, as shown in FIG. 2B, welding pad 86 rests upon upper surface 58 of bottom flute 38. Referring briefly to FIGS. 5A and 5B, spaced tab 78 has a central slotted aperture formed therein for extending about the sidelap interconnection formed between adjoining fluted deck panels 30 and 32. One portion of slotted tab 78 terminates in a first weld pad 88 for resting upon the upper surface of partial bottom flute 50, while the opposing portion of spaced tab 78 terminates in a welding pad 88' which rests upon partial bottom flute 54.

Referring to FIGS. 2A and 2B, shear resisting member 62 is interconnected with fluted deck diaphragm 20 and the underlying horizontal support beam 22 in the manner now described. Shear resisting member 62 is positioned directly above upper flange 24 or horizontal support beam 22, whereby welding pads 84–92 are positioned directly above upper flange 24. Horizontal flange 64 is secured to each top flute over which it lies, preferably by forming a fillet weld of approximately one-sixteenth inch in depth and one inch in length between the first side portion 70 of horizontal flange 64 and the upper surface of each top flute. For example, within FIGS. 2A and 2B, a fillet weld 94 is shown as formed between side portion 70 of horizontal flange 64 and the upper surface of top flute 34. Similarly, fillet weld 96 is formed between side portion 70 of flange 64 and the upper surface of top flute 36. Reference numerals 98 and 100 designate additional fillet welds formed between horizontal flange 64 and the top flutes of fluted deck panel 32. Fillet welds 94–100 rigidly secure horizontal flange 64 of shear resisting member 62 to each top flute over which flange 64 extends. While fillet welds 94–100 are shown as formed along first side portion 70, then may just as easily be made along first side portion 72.

Each of weld pads 84–92 is rigidly secured to the bottom flute upon which it rests and to the underlying upper flange 24 of horizontal support beam 22 by a second series of welds. Preferably, each weld pad includes an aperture formed therein, such as aperture 102 formed within weld pad 86. These apertures formed within weld pads 84–92 facilitate the formation of an arc spot weld 104, as shown in FIGS. 2A and 2B. As shown in FIG. 2B, arc spot weld extends through bottom flute 38 for both rigidly securing weld pad 86 to the upper surface of bottom flute 38 and rigidly securing weld pad 86 and bottom flute 38 collectively to the underlying support flange 24 of horizontal support beam 22. Similar arc spot welds are formed at each of weld pads 84, 88, 88', 90 and 92. In this manner, horizontal shear loading imposed upon fluted deck diaphragm 20 is transferred to underlying horizontal support beam 22 for being resisted by vertical load bearing member 28. Shear resisting member 62 thereby serves to stiffen the fluted deck diaphragm 20 and increases its resistance to deformation induced by such horizontal shear loads.

As shown in FIGS. 1, 2A and FIG. 6, spaced tabs 74 and 82 disposed adjacent first end 66 and second end 68, respectively, of shear resisting member 62 are each approximately one-half the width of intermediate tabs 76, 78 and 80. Similarly, weld pads 84 and 92 are approximately one-half the width of intermediate weld pads 86 and 90. It may be desired to form a substantially continuous shear resisting member extending entirely across the width of the fluted deck diaphragm 20. Referring to FIG. 6, end tab 82 of shear resisting member 62 is shown extending within a trough defined by a bottom flute 106 of a fluted deck panel, and weld pad 92 is arc spot welded to bottom flute 106. Also shown in FIG. 6 is an abutting end of a further shear resisting member 110 and including an end tab 112 terminating in a weld pad 114. As will be appreciated, by making each of end tabs 82 and 112 one-half the width of the trough defined by bottom flute 106, weld pads 92 and 114 may both be welded to bottom flange 106 and permit shear resisting members 62 and 110 to be placed in abutting end-to-end relationship, with end tabs 82 and 112 sharing a common trough.

Figure 4:
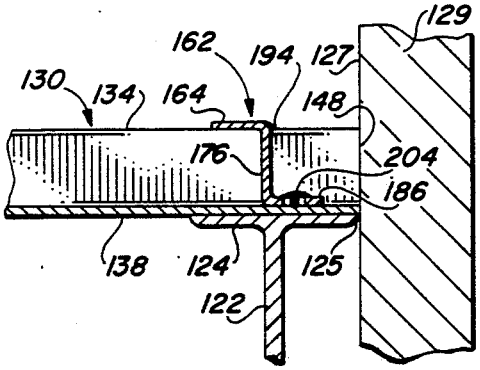
FIG. 4 is a sectional view of the fluted deck diaphragm shown in FIG. 3, taken through the plane designated by lines 4—4 in FIG. 3, and further illustrating the aforementioned external vertical wall.

It will be recalled that one aspect of the present invention is to provide a fluted deck diaphragm structure capable of resisting horizontal shear loads and wherein the open end of the deck may be coextensive with the external edge of the upper flange of an underlying horizontal support beam for allowing the fluted deck diaphragm to abut the interior surface of an external vertical wall. With reference to FIGS. 3 and 4, such a fluted deck diaphragm structure is shown incorporating the shear resisting member of the type shown in FIG. 1. Within FIGS. 3 and 4, a fluted deck 120 includes a first fluted deck panel 130 and a second fluted deck panel 132 joined along their side edges by a sidelap interconnection seam designated by reference numeral 153. The open ends of fluted deck panels 130 and 132 are supported upon upper flange 124 of horizontal support beam 122. Horizontal support beam 122 extends perpendicular to the longitudinal axis of fluted deck 120. Upper flange 124 of horizontal support beam 122 includes an outermost edge 125 which, as shown in FIG. 4, lies adjacent and parallel to the inner surface 127 of outer vertical wall 129. As shown in FIG. 4, the end 148 of fluted deck panel 130 extends substantially coextensive with external side edge 125 of upper flange 124, whereby end 148 abuts interior surface 127 of vertical wall 129.

As shown in FIGS. 3 and 4, shear resisting member 162 extends perpendicular to the longitudinal axis of fluted deck diaphragm 120 and generally above and parallel to horizontal support beam 122. The upper horizontal flange 164 extends over and adjacent to top flutes 134 and 136 of fluted deck panel 130, and over and adjacent top flute 137 of fluted deck panel 132. Spaced tabs 174, 176, and 178 extend downwardly from side edge 170 of horizontal flange 164; welding pads 184 and 186 extend horizontally from the lowermost portions of spaced tabs 174 and 176, respectively, and overlie the upper surfaces of bottom flutes 140 and 138 of fluted deck panel 130, respectively. Weld pads 188 and 188' extend horizontally from the lowermost portions of slotted tab 178 and overlie the partial bottom flute 150 of fluted deck panel 130 and partial bottom flute 154 of fluted deck panel 132, respectively. Fillet welds 194, 196, and 198, each being one-sixteenth inch deep and one inch in length, rigidly secure side edge 170 of horizontal flange 164 to top flutes 134, 136, and 137, respectively. As shown in FIG. 4, weld pad 186 is rigidly secured by arc spot weld 204 to bottom flute 138 and to upper flange 124 of horizontal support beam 122. Similarly, welding pads 184, 188, and 188' are arc spot welded to their corresponding bottom flutes and to upper flange 124 of horizontal support beam 122.

Those skilled in the art will appreciate that the fluted deck diaphragm structure shown in FIGS. 3 and 4 allows the fluted deck to extend fully to the interior surface of an external vertical wall, while shear resisting member 162 stiffens the deck against deformation caused by the imposition of horizontal shear loads. As explained above, shear resisting member 162 further serves to transfer horizontal shear forces imposed upon fluted deck diaphragm 120 to the underlying horizontal support beam 122. Moreover, shear resisting member 162 may easily be installed after fluted deck panels 130 and 132 are secured to horizontal support beam 122, even after the normally open end 148 of fluted deck panel 130 is closed off and rendered inaccessible by the abutting vertical wall 129.

As mentioned above, fluted deck panels that are commercially available are also provided in varying widths. For example, fluted deck panels of a given height or depth are often supplied in both 24 inch wide panels and 36 inch wide panels. A shear resisting member of the type shown in FIG. 1 may have a length equal to the width of the narrower variety of fluted deck panels and still be used with the wider variety of fluted deck panels. For example, the shear resisting member shown in FIG. 1 may be made to have a length of 24 inches and be used with both 24 inch wide and 36 inch wide fluted deck panels, as explained below.

Figures 7, 8, 9, 10:
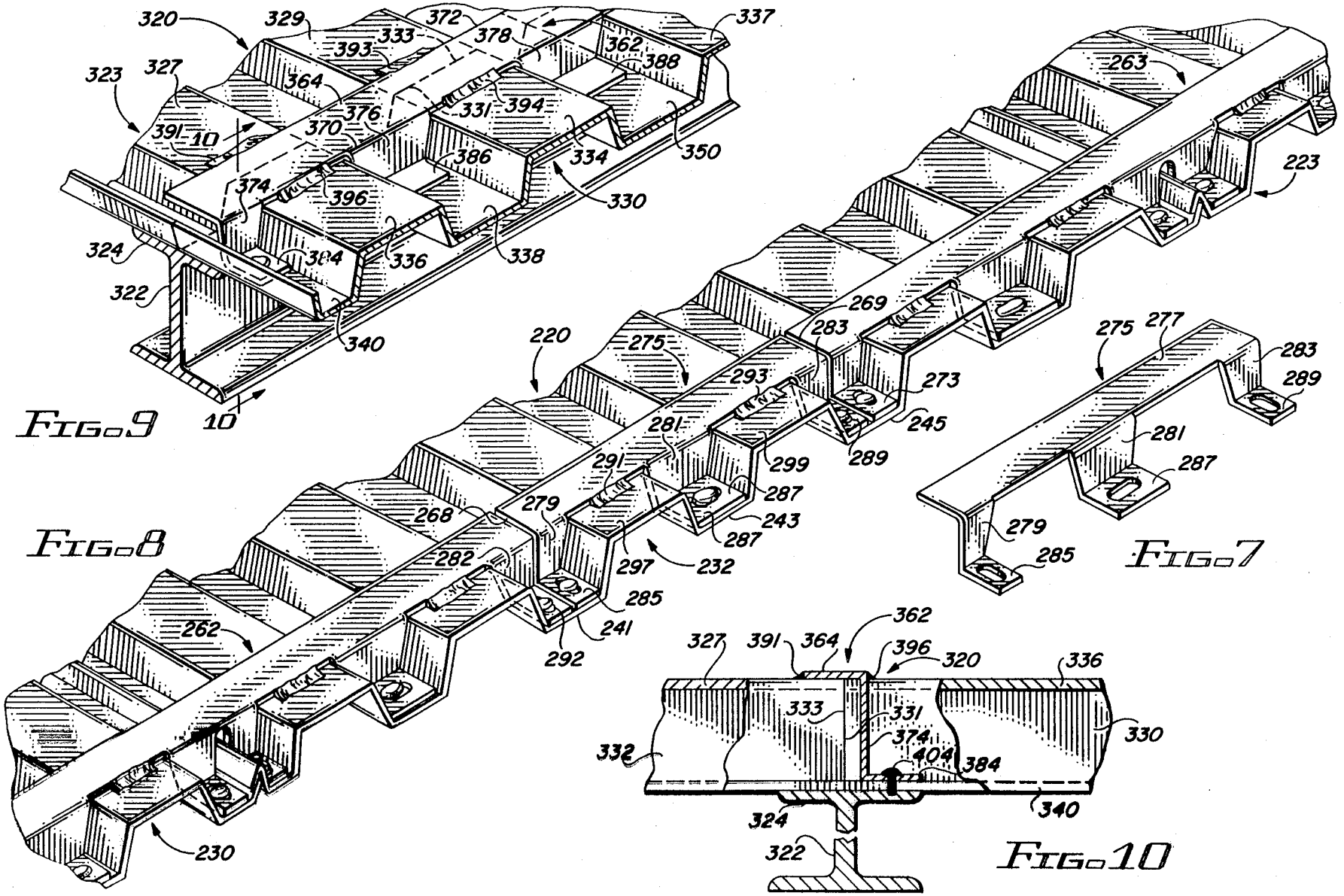
FIG. 7 illustrates an alternate form of abbreviated shear resisting member including two half-width tabs at the opposing end thereof and a full width tab midway therebetween.
FIG. 8 is a perspective view of a fluted deck panel including a multiple segment shear resisting member incorporating the shear resisting members shown in FIGS. 1 and 7.
FIG. 9 is a perspective view of a fluted deck diaphragm constructed according to the teachings of the present invention and wherein a shear resisting member is installed at an interior butt joint along which two fluted deck panels are in end-to-end abutting relationship.
FIG. 10 is a sectional view of the fluted deck diaphragm shown in FIG. 9 and taken through the plane indicated by lines 10—10 within FIG. 9.

Referring to FIG. 8, a fluted deck diaphragm 220 is shown composed of sidelapped 36 inch fluted deck panels 230, 232, and 233. A pair of shear resisting members 262 and 263, of the type shown in FIG. 1, span the sidelap interconnection formed between fluted deck panels 230 and 232, and between fluted deck panels 232 and 233, respectively. Fluted deck panel 232 includes bottom flutes 241, 243 and 245. The rightmost end 268 of shear resisting member 262 includes an end tab 282 which terminates at its lowermost portion in weld pad 292 welded to one-half of bottom flute 241. Similarly, the leftmost end 269 of shear resisting member 263 includes an end tab 271 extending downwardly therefrom and terminating in a weld pad 273 welded at one-half of bottom flute 245. End 268 of shear resisting member 262, and end 269 of shear resisting member 263, are separated from one another by a distance of 12 inches.

To form a substantially continuous shear resisting member system along the entire width of the fluted deck diaphragm 220, a shortened shear resisting member 275 may be provided as depicted in FIG. 7. Shear resisting member 275 has a length of 12 inches and includes a horizontal upper flange 277 as well as three spaced tabs 279, 281, and 283, and weld pads 285, 287, and 289 extending horizontally from the lowermost portions of spaced tabs 279, 281 and 283, respectively. End tabs 279 and 283, and their corresponding weld pads 285 and 289, are one-half the width of intermediate tab 281 and intermediate weld pad 287, respectively. As shown in FIG. 8, shear resisting member 275 is installed between end 268 of shear resisting member 262 and end 269 of shear resisting member 263. Weld pad 285 is welded to one-half of bottom flute 241, intermediate weld pad 287 is welded to bottom flute 243, and weld pad 289 is welded to one-half of bottom flute 245. Upper horizontal flange 277 is secured by fillet welds 291 and 293 to top flutes 297 and 299, respectively, in the same manner used to weld shear resisting members 262 and 263.

Shear resisting member 275 shown in FIG. 7 is easily produced by first providing a shear resisting member like that shown in FIG. 1, but omitting the slotted opening in spaced tab 78; such shear resisting member is then cut in half transversely through spaced tab 78 (see FIG. 1). In this manner, a pair of shear resisting members like that shown in FIG. 7 is easily and quickly produced from a shear resisting member like that shown in FIG. 1.

It will be recalled that another aspect of the present invention is to provide a fluted deck diaphragm capable of resisting horizontal shear loads imposed upon the diaphragm and transferring such horizontal shear loads to an internal horizontal support beam, i.e., a horizontal support beam that extends internally through the diaphragm rather than along a peripheral edge of the diaphragm including an internal butt joint formed between two successive fluted deck panels having a common longitudinal axis and incorporating a shear resisting member for transferring horizontal shear loads to an underlying internal horizontal support beam. As shown in FIGS. 9 and 10, an internal horizontal support beam 322 includes an upper horizontal flange 324. A fluted deck diaphragm 320 includes a first fluted deck panel 330 and a second fluted deck panel 332. Fluted deck panel 330 includes a first end 331 and an opposing second end (not shown). Fluted deck panel 332 includes a first end 333 and an opposing second end (not shown). End 333 of fluted deck panel 332 lies adjacent and abutted against end 331 of fluted deck panel 330 to form an interior butt joint within fluted deck diaphragm 320. Both horizontal support beam 322 and the aforementioned interior butt joint extend perpendicular to the longitudinal axes of fluted deck panels 330 and 332. As shown in FIGS. 9 and 10, the interior butt joint is preferably centered over upper flange 324 of horizontal support beam 322. Thus, horizontal support beam 322 simultaneously supports end 331 of fluted deck panel 330 and end 333 of fluted deck panel 332.

Still referring to FIGS. 9 and 10, shear resisting member 362 includes an elongated upper horizontal flange 364 which extends generally above and parallel to horizontal support beam 322 and straddles the abutting ends 331 and 333 of fluted deck panels 330 and 332, respectively. Thus, upper horizontal flange 364 simultaneously overlies top flutes 334, 336 and 337 of fluted deck panel 330 and top flutes 327 and 329 of fluted deck panel 332. Side edge 370 of upper horizontal flange 364 is secured by fillet welds 394 and 396, each one-sixteenth inch deep and one inch long, to top flanges 334 and 336, respectively. Opposing side portion 372 is secured by similar fillet welds 391 and 393 to top flanges 327 and 329, thereby rigidly attaching top flange 334 to top flange 329, and rigidly attaching top flange 336 to top flange 327. In this manner, the top flanges of abutting fluted deck panels are joined to form an integral structure.

Extending downwardly from side portion 370 of upper horizontal flange 364 are spaced tabs 374, 376 and 378 extending horizontally from the lowermost portions of spaced tabs 374, 376 and 378 apertured weld pads 384, 386, and 388, respectively. Weld pads 384, 386 and 388 overlie bottom flutes 340, 338, and 350, respectively, of fluted deck panel 330, and each such weld pad is arc spot welded through its associated bottom flange to upper flange 324 of horizontal support beam 322 lying therebelow. In FIG. 10, for example, weld pad 384 is shown secured by arc spot weld 404 through bottom flute 340 to the underlying support flange 324 of horizontal support beam 322. In this manner, shear resisting member 362 simultaneously serves to join the abutting ends of the fluted deck panels forming the interior butt joint, and further serves to transfer horizontal shear loads imposed upon the collective diaphragm to underlying internal horizontal support beam 322.

Figure 11:
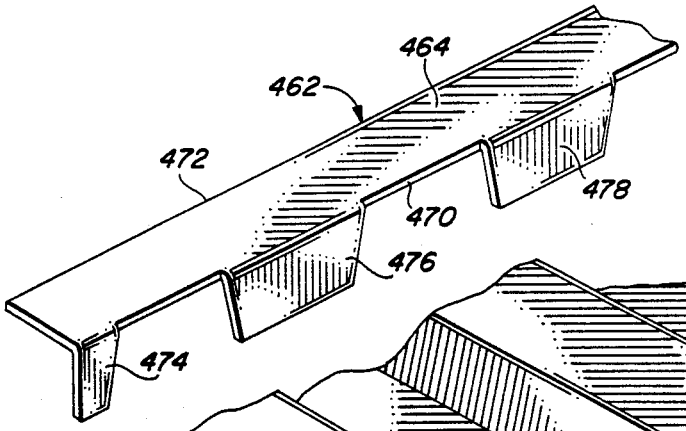
FIG. 11 shows an alternate form of shear resisting member omitting welding pads at the lowermost portions of the spaced tabs thereof.

While the preferred embodiment of the above-described shear resisting member includes weld pads extending horizontally from the lowermost portions of each of the spaced tabs, it is also possible to provide such a shear resisting member omitting such weld pads. Referring to FIG. 11, a portion of such a shear resisting member is shown. Shear resisting member 462 of FIG. 11 includes an elongated upper horizontal flange 464 having opposing side portions 470 and 472. Extending downwardly from side portion 470 of horizontal flange 464 are a series of spaced tabs 474, 476, and 478, as well as additional spaced tabs (not shown). As in the case of shear resisting member 62 shown in FIG. 1, spaced tabs 474, 476 and 478 are spaced apart from one another in accordance with the center to center distance separating the bottom flutes of the fluted deck panel with which shear resisting member 462 is designated to be used. Similarly, the height of each such spaced tab corresponds with the depth of the troughs within the fluted desk in which the shear resisting member 462 is to be incorporated.

Figure 12:
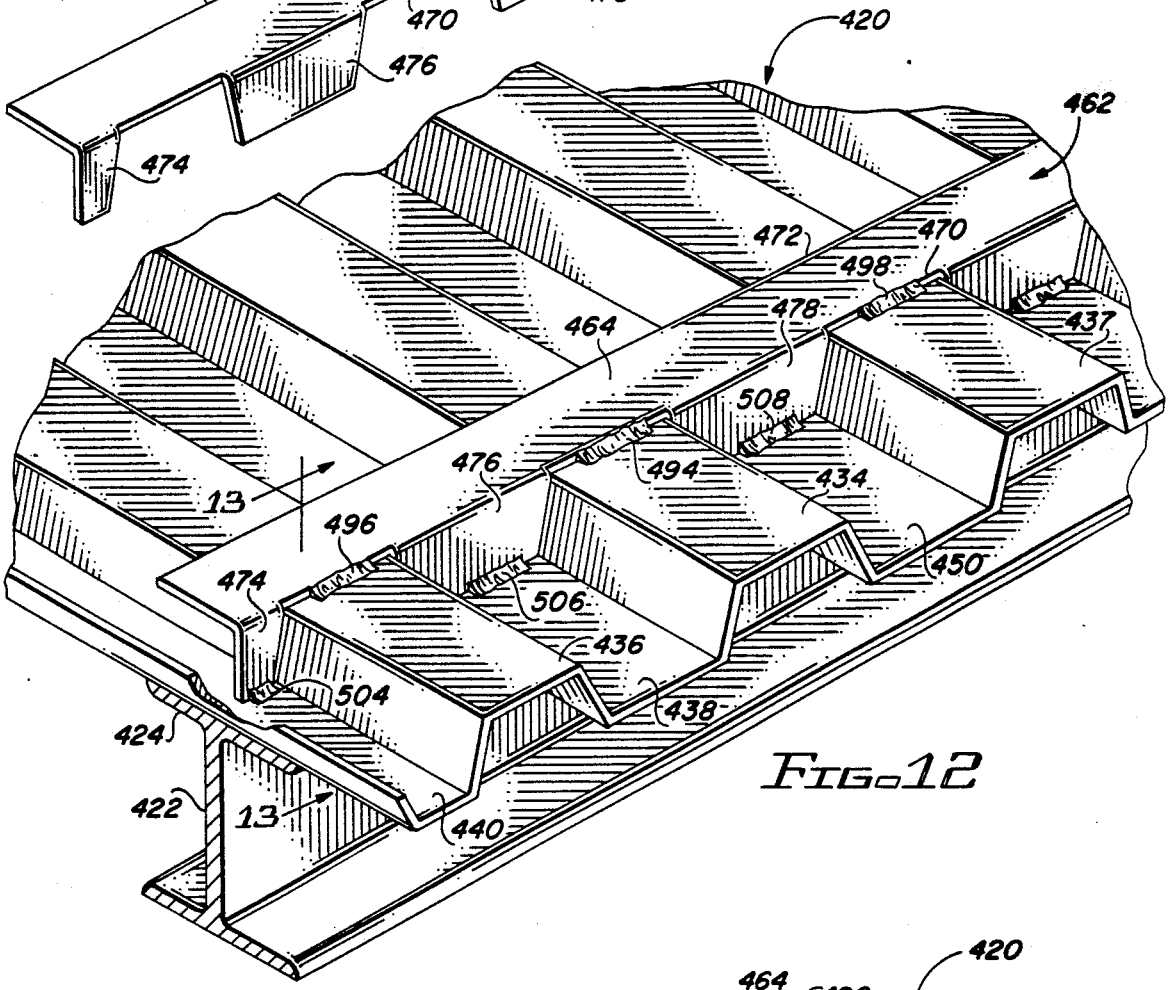
FIG. 12 is a perspective view of a cantilevered fluted deck diaphragm constructed according to the teachings of the present invention and utilizing a shear resisting member of the type shown in FIG. 11.
Figure 13:
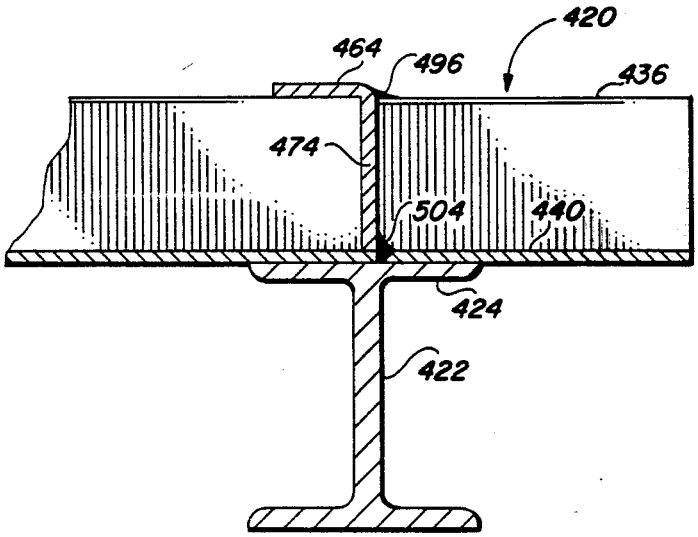
FIG. 13 is a sectional view of the cantilevered fluted deck diaphragm shown in FIG. 12 taken through the plane designated by lines 13—13 within FIG. 12.

FIGS. 12 and 13 illustrate the manner by which shear resisting member 464 is welded to a fluted deck diaphragm and to an underlying horizontal support beam. Fluted deck diaphragm 420 shown in FIGS. 12 and 13 is a cantilevered configuration like that shown in FIGS. 2A and 2B. Horizontal support beam 422 extends perpendicular to the longitudinal axis of fluted deck diaphragm 420, and bottom flutes 438, 440 and 450 of fluted deck diaphragm 420 rest upon upper support flange 424 for being supported thereby.

Upper horizontal flange 464 overlies top flutes 434, 436 and 437 and is rigidly attached to each such top flute along side edge portion 470 by fillet welds 494, 496 and 498, respectively. The lowermost portion of end tab 474 lies substantially adjacent bottom flute 440, as shown in FIG. 13. Similarly, the lowermost portions of spaced tabs 476 and 478 extend substantially adjacent to bottom flutes 438 and 450. The lowermost portion of each such spaced tab is rigidly attached to the upper surface of its associated bottom flute, and through the associated bottom flute, to the underlying support flange of the horizontal support beam. The aforementioned rigid attachment is made by a weld, preferably a fillet weld made to a depth of one-eighth inch and having a length of one and one-half inches. Thus, within FIGS. 12 and 13, fillet weld 504 secures the lowermost portion of end tab 474 to the upper surface of bottom flute 440, and extends through bottom flute 440 to the underlying horizontal support flange 424. Similar fillet welds 506 and 508 secure the lowermost portions of tabs 476 and 478 to the upper surface of bottom flutes 438 and 450, respectively, and to the underlying horizontal support flange 424.

Those skilled in the art will appreciate that the improved diaphragm structure described herein provides a fluted deck diaphragm having a relatively high degree of stiffness and adapted to readily transfer horizontal shear loads to the building skeletal framework, notwithstanding the use of relatively light gauge fluted deck panels to form such diaphragm. The described fluted deck diaphragm may be easily constructed to extend in a cantilevered configuration wherein the open end of the diaphragm is not supported by an underlying horizontal support beam. It will also be appreciated that the improved diaphragm structure described herein may easily be constructed to position the open end of the fluted deck to lie flush with the interior surface of an external vertical wall. It will further be appreciated that the improved fluted deck diaphragm described herein may incorporate shear resisting members which may be installed at interior butt joints within the diaphragm and which attach top flutes of abutting fluted deck panels to each other and simultaneously transfer horizontal shear loads imposed upon the diaphragm to an underlying internal horizontal support beam. While the present invention has been described with reference to several preferred embodiments thereof, the description is for illustrative purposes only and is not to be constructed as limiting the scope of the invention. Various modifications and changes may be made by those skilled in the art without departing from the true spirit and scope of the invention as defined by the appended claims.

I claim:

1. A diaphragm for use in a building structure, said building structure including a series of horizontal load bearing members for supporting said diaphragm and a series of vertical load resisting members for supporting the horizontal load bearing members, said diaphragm comprising in combination:

a. a fluted deck having a longitudinally axis and including a plurality of alternating top and bottom flutes extending parallel to the longitudinal axis of said fluted deck between first and second ends thereof, said plurality of top flutes lying substantially in a first plane, and said plurality of bottom flutes lying substantially in a second plane spaced apart from and parallel to said first plane, said fluted deck including a plurality of webs extending parallel to the longitudinal axis of said fluted deck and interconnecting alternating top and bottom flutes, said plurality of bottom flutes of said fluted deck each having an upper surface and a lower surface, the lower surfaces of said bottom flutes overlying at least one of said horizontal load bearing members for being supported thereby, the longitudinal axis of said fluted deck extending generally perpendicular to said at least one horizontal load bearing member;

b. a shear resisting member for stiffening said fluted deck and increasing the resistance of said fluted deck to deformation induced by horizontal shear loads imposed upon said diaphragm by transferring such horizontal shear loads to said at least one horizontal load bearing member, said shear resisting member including an elongated section extending generally perpendicular to the longitudinal axis of said fluted deck and extending over a plurality of said top flutes of said fluted deck, said shear resisting member extending generally above and parallel to said at least one horizontal load bearing member, said shear resisting member further including a plurality of spaced tabs extending downwardly from said elongated section toward the upper surface of one of said bottom flutes, each of said spaced tabs extending within a trough formed by one of said bottom flutes and said webs interconnected therewith, each of said spaced tabs having a lowermost portion disposed adjacent the upper surface of one of said bottom flutes;

c. first welds for rigidly securing said elongated section of said shear resisting member to said plurality of top flutes of said fluted deck over which said shear resisting member extends; and d. second welds for rigidly securing the lowermost portion of each of said spaced tabs of said shear resisting member to the upper surface of one of said bottom flutes and for securing each said bottom flute to said at least one horizontal load bearing member.

2. A diaphragm as recited by claim 1 wherein:

a. said fluted deck includes at least first and second fluted deck panels disposed in side-to-side relationship, the first fluted deck panel including a bottom flute extending along a side thereof and including a first upwardly directed web extending therealong, the second fluted deck including a bottom flute extending along a side thereof and including a second hooked extending therealong, said second hooked web extending around and overlapping said first web to form a sidelap interconnection between said first and second fluted deck panels; and b. said shear resisting member extends across said sidelap interconnection, one of said plurality of spaced tabs having a slot formed therein for permitting said slotted tab to extend around the sidelap interconnection formed between said first and second fluted panels.

3. A diaphragm as recited by claim 1 wherein said shear resisting member extends between first and second ends, said plurality of spaced tabs including first and second end tabs disposed at the first and second ends, respectively, of said shear resisting member and including at least a third tab disposed intermediate said first and second end tabs, the bottom flutes of said fluted deck having a predetermined width, said third tab having a width substantially equal to said predetermined width, said first and second end tabs each having a width of substantially one-half the width of said third tab to allow two shear resisting members to be placed in abutting end-to-end relationship wherein successive end tabs of abutting shear resisting members are disposed within a common trough.

4. A diaphragm as recited by claim 1 wherein said at least one horizontal load bearing member is closer to the first end of said fluted deck than to the second end of said fluted deck, and wherein the first end of said fluted deck extends substantially beyond said at least one horizontal load bearing member to provide a cantilevered deck structure.

5. A diaphragm recited by claim 1 wherein said building structure includes at least one outer vertical wall having an interior surface extending parallel to and adjacent to said at least one horizontal load bearing member, said at least one horizontal load bearing member including an upper flange having an outer edge lying substantially adjacent to the interior surface of said vertical wall, the first end of said fluted deck extending substantially adjacent to the interior surface of said vertical wall and substantially adjacent to the outer edge of said upper flange.

6. A diaphragm as recited by claim 1 wherein:

a. said at least one horizontal load bearing member is an interior horizontal load bearing member;

b. said fluted deck includes at least first and second fluted deck panels each having first and second ends, said first and second fluted deck panels being disposed in end-to-end relationship with an end of said first fluted deck panel being butted against an end of said second fluted deck panel, the abutting ends of said first and second fluted deck panels each overlying and being supported by said at least one horizontal load bearing member;

c. said elongated section of said shear resisting member is a substantially planar horizontal flange, said horizontal flange of said shear resisting member extending above the abutting ends of said first and second fluted deck panels and simultaneously overlying a first plurality of top flutes of said first fluted deck panel and overlying a second plurality of top flutes of said second fluted deck panel;

d. said first welds rigidly secure said horizontal flange of said shear resisting member to said first plurality of top flutes and to said second plurality of top flutes to join the abutting ends of said first and second fluted deck panels; and e. said second welds rigidly secure the lowermost portions of said spaced tabs of said shear resisting member to the upper surface of the bottom flutes of said first fluted deck panel and rigidly secure the bottom flutes of said first fluted deck panel to said at least one horizontal load bearing member to stiffen said fluted deck along an interior horizontal load bearing member and to transfer horizontal shear loads imposed upon said fluted deck to said interior horizontal load bearing member.

7. A diaphragm as recited by claim 6 wherein said horizontal flange has first and second opposing side portions, said plurality of spaced tabs extend from said first side portion, and said first welds include fillet welds formed between said first plurality of top flutes and said horizontal flange along said first side portion, said first welds also including fillet welds formed between said second plurality of top flutes and said horizontal flange along said second side portion thereof.

8. A diaphragm as recited by claim 1 wherein said elongated section of said shear resisting member is a substantially planar horizontal flange and lies within a plane that is parallel to and adjacent to said first plane containing said plurality of top flutes.

9. A diaphragm as recited by claim 8 wherein said horizontal flange has first and second opposing side portions, said plurality of spaced tabs extend from said first side portion, and said first welds include fillet welds formed between said top flutes and said horizontal flange along said first side portion.

10. A diaphragm as recited by claim 8 wherein said shear resisting member includes a plurality of pads, each of said pads extending from the lowermost portion of one of said plurality of spaced tabs generally perpendicular to each spaced tab and extending generally parallel to and adjacent to the upper surface of a bottom flute for being secured thereto by one of said second welds.

11. A diaphragm as recited by claim 10 wherein each of said pad has a hole formed therein to facilitate the formation of said second welds.

12. A building for resisting horizontal shear loads imposed by earthquakes, high winds and the like, said building comprising in combination:

a. vertical load resisting members for absorbing horizontal shear loads imposed upon the building;

b. horizontal load bearing members attached to said vertical load resisting members for translating horizontal shear loads to said vertical load resisting members;

c. a diaphragm supported by said horizontal load bearing members, said diaphragm including:

i. a fluted deck having a longitudinal axis and including a plurality of alternating top and bottom flutes extending parallel to the longitudinal axis of said fluted deck between first and second ends thereof, said plurality of top flutes lying substantially in a first plane, and said plurality of bottom flutes lying substantially in a second place spaced apart from and parallel to said first plane, said fluted deck including a plurality of webs extending parallel to the longitudinal axis of said fluted deck and interconnecting alternating top and bottom flutes, said plurality of bottom flutes of said fluted deck each having an upper surface and a lower surface, the lower surfaces of said bottom flutes overlying at least one of said horizontal load bearing members for being supported thereby, the longitudinal axis of said fluted deck extending generally perpendicular to said at least one horizontal load bearing member;

ii. a shear resisting member for stiffening said fluted deck and increasing the resistance of said fluted deck to deformation induced by horizontal shear loads imposed upon said diaphragm by transferring such horizontal shear loads to said at least one horizontal load bearing member, said shear resisting member including an elongated section extending generally perpendicular to the longitudinal axis of said fluted deck and extending over a plurality of said top flutes of said fluted deck, said shear resisting member extending generally above and parallel to said at least one horizontal load bearing member, said shear resisting member further including a plurality of spaced tabs extending downwardly from said elongated section toward the upper surface of one of said bottom flutes, each of said spaced tabs extending within a trough formed by one of said bottom flutes and said webs interconnected therewith, each of said spaced tabs having a lowermost portion disposed adjacent the upper surface of one of said bottom flutes;

iii. first welds for rigidly securing said elongated section of said shear resisting member to said plurality of top flutes of said fluted deck over which said shear resisting member extends; and iv. second welds for rigidly securing the lowermost portion of each of said spaced tabs of said shear resisting member to the upper surface of one of said bottom flutes and for securing each said bottom flute to said at least one horizontal load bearing member.

13. A building as recited by claim 12 wherein:

a. said fluted deck includes at least first and second fluted deck panels disposed in side-to-side relationship, the first fluted deck panel including a bottom flute extending along a side thereof and including a first upwardly directed web extending therealong, the second fluted deck including a bottom flute extending along a side thereof and including a second hooked web extending therealong, said second hooked web extending around and overlapping said first web to form a sidelap interconnection between said first and second fluted deck panels; and b. said shear resisting member extends across said sidelap interconnection, one of said plurality of spaced tabs having a slot formed therein for permitting said slotted tab to extend around the sidelap interconnection formed between said first and second fluted panels.

14. A building as recited by claim 12 wherein said shear resisting member extends between first and second ends, said plurality of spaced tabs including first and second end tabs disposed at the first and second ends, respectively, of said shear resisting member and including at least a third tab disposed intermediate said first and second tabs, the bottom flutes of said fluted deck having a predetermined width, said third tab having a width substantially equal to said predetermined width, said first and second end tabs each having a width of substantially one-half the width of said third tab to allow two shear resisting members to be placed in abutting end-to-end relationship wherein successive end tabs of abutting shear resisting members are disposed within a common trough.

15. A diaphragm as recited by claim 12 wherein said at least one horizontal load bearing member is closer to the first end of said fluted deck than to the second end of said fluted deck, and wherein the first end of said fluted deck extends substantially beyond said at least one horizontal load bearing member to provide a cantilevered deck structure.

16. A building recited by claim 12 wherein said building includes at least one outer vertical wall having an interior surface extending parallel to and adjacent to said at least one horizontal load bearing member, said at least one horizontal load bearing member including an upper flange having an outer edge lying substantially adjacent to the interior surface of said vertical wall, the first end of said fluted deck extending substantially adjacent to the interior surface of said vertical wall and substantially adjacent to the outer edge of said upper flange.

17. A building as recited by claim 12 wherein:

a. said at least one horizontal load bearing member is an interior horizontal load bearing member;

b. said fluted deck includes at least first and second fluted deck panels each having first and second ends, said first and second fluted deck panels being disposed in end-to-end relationship with an end of said first fluted deck panel being butted against an end of said second fluted deck panel, the abutting ends of said first and second fluted deck panels each overlying and being supported by said at least one horizontal load bearing member;

c. said elongated section of said shear resisting member is a substantially planar horizontal flange, said horizontal flange of said shear resisting member extending above the abutting ends of said first and second fluted deck panels and simultaneously overlying a first plurality of top flutes of said first fluted deck panel and overlying a second plurality of top flutes of said second fluted deck panel;

d. said first welds rigidly secure said horizontal flange of said shear resisting member to said first plurality of top flutes and to said second plurality of top flutes to joint the abutting ends of said first and second fluted deck panels; and e. said second welds rigidly secure the lowermost portions of said spaced tabs of said shear resisting member to the upper surface of the bottom flutes of said first fluted deck panel and rigidly secure the bottom flutes of said first fluted deck panel to said at least one horizontal load bearing member to stiffen said fluted deck along an interior horizontal load bearing member and to transfer horizontal shear loads imposed upon said fluted deck to said interior horizontal load bearing member.

18. A building as recited by claim 17 wherein said horizontal flange has first and second opposing side portions, said plurality of spaced tabs extend from said first side portion, and said first welds include fillet welds formed between said first plurality of top flutes and said horizontal flange along said first side portion, said first welds also including fillet welds formed between said second plurality of top flutes and said horizontal flange along said second side portion thereof.

19. A building as recited by claim 12 wherein said elongated section of said shear resisting member is a substantially planar horizontal flange and lies within a plane that is parallel to and adjacent to said first plane containing said plurality of top flutes.

20. A building as recited by claim 19 wherein said horizontal flange has first and second opposing side portions, said plurality of spaced tabs extend from said first side portion, and said first welds include fillet welds formed between said top flutes and said horizontal flange along said first side portion.

21. A building as recited by claim 19 wherein said shear resisting member includes a plurality of pads, each of said pads extending from the lowermost portion of one of said plurality of spaced tabs generally perpendicular to each spaced tab and extending generally parallel to and adjacent to the upper surface of a bottom flute for being secured thereto by one of said second welds.

22. A building as recited by claim 21 wherein each of said pads has a hole formed therein to facilitate the formation of said second welds.

23. A method of constructing a diaphragm for use in a building structure, said building structure including a series of horizontal load bearing members for supporting said diaphragm and a series of vertical load resisting members for supporting the horizontal load bearing members, said method comprising the steps of:

a. providing a fluted deck having a longitudinal axis and including a plurality of alternating top and bottom flutes extending parallel to the longitudinal axis of said fluted deck between first and second ends thereof, said plurality of top flutes lying substantially in a first plane, and said plurality of bottom flutes lying substantially in a second plane spaced apart from and parallel to said first plane, said fluted deck including a plurality of webs extending parallel to the longitudinal axis of said fluted deck and interconnecting alternating top and bottom flutes, said plurality of bottom flutes of said fluted deck each having an upper surface and a lower surface;

b. positioning the lower surfaces of the bottom flutes of said fluted deck to overlie at least one of said horizontal load bearing members for being supported thereby, and disposing the longitudinal axis of said fluted deck to extend generally perpendicular to said at least one horizontal load bearing member;

c. providing a shear resisting member for stiffening said fluted deck and increasing the resistance of said fluted deck to deformation induced by horizontal shear loads imposed upon said diaphragm by transferring such horizontal shear loads to said at least one horizontal load bearing member, said shear resisting member including an elongated section and further including a plurality of spaced tabs extending downwardly from said elongated section;

d. positioning said shear resisting member to extend generally perpendicular to the longitudinal axis of said fluted deck and extending over a plurality of said top flutes of said fluted deck generally above and parallel to said at least one horizontal load bearing member, with said plurality of spaced tabs each extending downwardly toward the upper surface of one of said bottom flutes, and with each of said spaced tabs extending within a trough formed by one of said bottom flutes and said webs interconnected therewith, with the lowermost portion of each of said spaced tabs disposed adjacent the upper surface of one said bottom flutes;

e. welding said elongated section of said shear resisting member to each of the top flutes of said fluted deck over which said shear resisting member extends; and f. welding the lowermost portion of each of said spaced tabs of said shear resisting member to the upper surface of one of said bottom flutes, and welding through each of said bottom flute to said at least one horizontal load bearing member.

24. A method as recited by claim 23 including the step of extending the first end of the fluted deck substantially beyond said at least one horizontal load bearing member to form a cantilevered deck structure.

25. A method as recited by claim 23 wherein said building structure includes at least one outer vertical wall having an interior surface extending parallel to and adjacent to said at least one horizontal load bearing member, and said at least one horizontal load bearing member including an upper flange having an outer edge, said method including the further steps of:

a. positioning said at least one horizontal load bearing member substantially adjacent and parallel to the interior surface of said vertical wall for placing the outer edge of said upper flange substantially adjacent to the interior surface of said vertical wall; and b. extending the first end of said fluted deck substantially adjacent to the interior surface of said vertical wall and substantially adjacent to the outer edge of said upper flange of said at least one horizontal load bearing member.

26. A method as recited by claim 23 wherein said fluted deck includes at least first and second fluted deck panels each having first and second ends, and wherein said elongated section of said shear resisting member is a substantially planar horizontal flange, said method including the steps of:

a. positioning said at least one horizontal load bearing member internally within said diaphragm;

b. disposing said first and second fluted deck panels in end-to-end relationship with an end of said first fluted deck panel butted against an end of said second fluted deck panel;

c. disposing the abutting ends of the first and second fluted deck panels to each overlie said at least one horizontal load bearing member for being supported thereby;

d. disposing the horizontal flange of said shear resisting member to extend along and above the abutting ends of said first and second fluted deck panels to simultaneously overlie a first plurality of top flutes of said first fluted deck panel and a second plurality of top flutes of said second fluted deck panel;

e. welding the horizontal flange of said shear resisting member to said first plurality of top flutes and to said second plurality of top flutes to join the abutting ends of said first and second fluted deck panels; and f. welding the lowermost portions of said spaced tabs of said shear resisting member to the upper surface of the bottom flutes of said first fluted deck panel and welding through the bottom flutes of said first fluted deck panel to said at least one horizontal load bearing member underlying the abutting ends of said first and second fluted deck panels to stiffen said fluted deck along an interior horizontal load bearing member and to transfer horizontal shear loads imposed upon said fluted deck to said interior horizontal load bearing member.

* * * * *